US006893319B1

(12) United States Patent
Ohba

(10) Patent No.: US 6,893,319 B1
(45) Date of Patent: May 17, 2005

(54) ARM FOR ELASTIC DOLL BODY, METHOD OF FORMING THE ARM PART, AND METAL MOLD FOR FORMING THE ARM PART

(75) Inventor: Kazuo Ohba, Saitama (JP)

(73) Assignee: Takara Co., Ltd., Tokyo (JP)

( * ) Notice: Subject to any disclaimer, the term of this patent is extended or adjusted under 35 U.S.C. 154(b) by 0 days.

(21) Appl. No.: 09/701,504

(22) PCT Filed: May 10, 2000

(86) PCT No.: PCT/JP00/02980

§ 371 (c)(1),
(2), (4) Date: Nov. 29, 2000

(87) PCT Pub. No.: WO00/67869

PCT Pub. Date: Nov. 16, 2000

(30) Foreign Application Priority Data

| | | |
|---|---|---|
| May 10, 1999 | (JP) | 11/129203 |
| Jul. 26, 1999 | (JP) | 11/210927 |
| Aug. 13, 1999 | (JP) | 11/229139 |
| Oct. 15, 1999 | (JP) | 11/294557 |

(51) Int. Cl.[7] ..... A63H 3/36
(52) U.S. Cl. ..... 446/390; 446/373
(58) Field of Search ..... 446/390, 354, 446/370, 393, 374, 330; 264/275, 279.1; 425/57, 121

(56) References Cited

U.S. PATENT DOCUMENTS

| | | | | |
|---|---|---|---|---|
| 2,644,272 A | * | 7/1953 | Cohn | |
| 3,277,601 A | * | 10/1966 | Ryan | |
| 3,628,282 A | * | 12/1971 | Johnson et al. | |
| 4,057,612 A | * | 11/1977 | Clark et al. | 264/275 |
| 4,279,099 A | | 7/1981 | Dyer et al. | |
| 4,470,784 A | * | 9/1984 | Piotrovsky | 425/116 |
| 5,644,833 A | | 7/1997 | Starkey | |
| 6,103,165 A | * | 8/2000 | Miura | 264/250 |
| 6,403,003 B1 | * | 6/2002 | Fekete et al. | 264/129 |
| 6,435,938 B1 | * | 8/2002 | Lee et al. | 446/390 |
| 6,464,557 B1 | * | 10/2002 | Ohba et al. | 446/391 |

FOREIGN PATENT DOCUMENTS

| | | | |
|---|---|---|---|
| GB | 1070705 | | 6/1967 |
| GB | 1137642 | | 12/1968 |
| JP | 61-169217 | | 7/1986 |
| JP | 361169217 A | * | 7/1986 |
| JP | 62-071616 | | 4/1987 |
| JP | 62071616 A | * | 4/1987 |
| JP | 405168772 A | * | 7/1993 |
| JP | 7-080890 | | 3/1995 |

OTHER PUBLICATIONS www.cityplastics.com.au—"ACETAL (Delrin) Technical Data Sheet".*

* cited by examiner

*Primary Examiner*—Derris H. Banks
*Assistant Examiner*—Ali Abdelwahed

(57) ABSTRACT

An arm (17A, 17B, 17C) for an elastic doll capable of preventing torsional rotation of a core (10) in a molding material molded. The elastic doll arm includes the core (10) made of metal and arranged therein. The metal core (10) is provided on a distal end thereof or a portion thereof positioned in proximity to the distal end with a spacer (13) having a sectional area smaller than that of the arm. A material for the spacer (13) and the molding material for the arm are compatible with each other, resulting in the spacer (13) being integrated with the molding material.

14 Claims, 14 Drawing Sheets

ARM FOR ELASTIC DOLL BODY, METHOD OF FORMING THE ARM PART, AND METAL MOLD FOR FORMING THE ARM PART

TECHNICAL FIELD

This invention relates to an arm for an elastic doll, a method for molding the same and a mold therefor, and more particularly to an arm for an elastic doll formed by insert molding wherein a core is embedded in a molded article or arm in a predetermined manner, a method for molding the same and a mold therefor.

BACKGROUND ART

In general, arms and legs for an elastic doll are constructed so as to be bent, to thereby permit the doll to make a desired pose, so that it may exhibit increased reality. For this purpose, it has been conventionally considered that a core is preferably incorporated or embedded in the arms and legs. Actually, an arm or leg member which has a core incorporated or embedded therein is known in the art.

However, in such an arm having a core embedded or incorporated therein, as shown in FIG. 17, a core 40 is embedded in a molded synthetic resin material 41 for an arm as if it floats in the molding material, resulting it in failing to be integrated with the molding material 41. Thus, even when it is attempted to return the arm to an original straight pose thereof after it is bent in one direction, the core 40 inherently carries out torsional rotation in the arm, to thereby cause the arm to make a pose of being bent in an opposite direction, resulting in the arm being hard to make a desired pose. Also, the conventional core-embedded arm has another problem of causing the core 40 to be exposed at a distal end 40*a* thereof from a surface of the arm.

Further, during forming of the arm by molding, the core is required to be stationarily held at a predetermined position in a molding space defined in a mold. However, when a molding material is injected into the molding space, an injection pressure of the molding material causes movement of the core in the molding space, resulting in the core being displaced or deviated from a center of the arm molded.

Conventionally, techniques of stationarily setting the core in the molding space while keeping it floating in the space are limited to a means of fixing both ends of the core on edges of the molding space or that of securely supporting an intermediate portion of the core which is arranged in the molding space by means of a support member such as a fine wire or the like. However, the former means requires to cut the core at each end of the molded article, resulting in a mark made by the cutting being left on the molded article, as disclosed in Japanese Patent Publication No. 16875/1991. Thus, although the means may be employed in legs of a doll wherein there is a portion which is out of sight such as a sole of each of the feet because the portion permits the mark to be ignored, it cannot be applied to arms because it is not desired to leave the marks on fingers. The latter means causes a mark formed by drawing the support member out of the molded article after the molding to be left in the form of a hole on a surface of the molded article although the hole is small, so that the molded article is deteriorated in appearance.

In order to solve the problems, techniques of fixing only one end of the core and rendering the other end of the core free would be considered. However, in order to stationarily hold the whole core by merely fixing only one end of the core, it is required to increase a whole size of a mold for molding the arm to rigidly fix the end of the core by means of a specific jig or the like, to thereby cause the techniques to be impractical. Also, an arm of a doll relatively reduced in size such as a dress-up doll is thin, so that, as shown in FIG. 18, a bit of movement of a core 50 during a molding operation possibly causes the core 50 to be shifted or deviated from a central position of a molded article or arm 51, so that the core may be often dangerously exposed. Therefore, the techniques are considered to be inapplicable to insert molding of a doll arm. Thus, in the prior art, a doll arm reduced in size is typically formed by slush molding. Unfortunately, slush molding causes a cavity to be formed in the arm, resulting in the arm having a touch different from that of a leg having a core embedded therein by insert molding, so that the arm gives a user an unbalanced and unnatural feeling or impression.

The present invention has been made so as to eliminate the foregoing disadvantage or problem of the prior art. Accordingly, it is an object of the present invention to provide an arm for an elastic doll which is capable of substantially preventing torsional rotation of a core in the arm.

It is another object of the present invention to provide a method for forming an arm for an elastic doll which is capable of stably holding a core at a predetermined position in the arm during a molding operation.

It is a further object of the present invention to provide a mold for forming of an arm for an elastic doll, which mold is capable of stably holding a core at a predetermined position in the arm during a molding operation while being simplified in structure.

DISCLOSURE OF INVENTION

In order to solve the above-described problems of the prior art, in accordance with one aspect of the present invention, an arm for an elastic doll, which arm is formed of a molding material by molding is provided. The arm is characterized in that a core made of metal is arranged in the arm, the core being provided on a distal end thereof or a portion thereof positioned in proximity to the distal end with a spacer having a sectional area smaller than that of the arm, the spacer being made of a material compatible with the molding material for the arm.

It is preferable that the spacer be provided on a periphery thereof with tapered projections.

It is preferable that the core be formed thereon with a detachment-preventing section for preventing detachment of the spacer therefrom.

It is preferable that the core be formed at the distal end thereof with a bent section and the spacer be formed with an engagement hole in which the bent section is engagedly fitted.

In accordance with another aspect of the present invention, a method for molding an arm for an elastic doll is provided. The method includes the steps of forming a molding space for molding a portion of the arm extending from a shoulder thereof to a hand thereof in a mold and arranging a metal core in the molding space so as to extend along a center of the molding space. The core is fixed at one end thereof in a proximal section of the molding space which corresponds to a proximal portion of the shoulder of the arm and the core is provided at the other end thereof or a portion thereof positioned in proximity to the other end with a spacer for keeping the core spaced at a predetermined interval from an inner surface of the molding space. The method also includes the step of injecting a molten molding material into the molding space. The spacer is made of a synthetic resin material which is compatible with the molding material and has a melting point equal to or below a molding temperature of the molding material.

Also, in accordance with this aspect of the present invention, a method for molding arms for an elastic doll is provided. The method includes the step of forming a pair of molding spaces for molding portions of the arms each extending from a shoulder of the arm to a hand thereof in a mold including mold members. The molding spaces are formed opposite to each other to permit proximal sections thereof which respectively correspond to proximal portions of the shoulders of the arms to face each other. The method also includes the step of arranging a metal core in the molding spaces so as to continuously extend along a center of the molding spaces. The core is provided at each of ends thereof or a portion thereof positioned in proximity to the end with a spacer for keeping the core spaced at a predetermined interval from an inner surface of the molding spaces. The method further includes the step of injecting a molten molding material into the molding spaces. The core is formed at a portion thereof positioned between the molding spaces with a bent section. The mold members have respective mating surfaces, one of which is formed thereon with projections engaged with the bent section of the core and opposite sides of the core to stationarily hold the core. The spacer is made of a synthetic resin material which is compatible with the molding material and has a melting point equal to or below a molding temperature of the molding material.

In accordance with this aspect of the present invention, a method for molding arms for an elastic doll is also provided. The method includes the step of forming a pair of molding spaces for molding portions of the arms each extending from a shoulder of the arm to a hand thereof in a mold including mold members. The molding spaces are formed opposite to each other to permit proximal sections thereof which respectively correspond to proximal portions of the shoulders of the arms to face each other. The method also includes the steps of arranging a metal core in the molding spaces so as to continuously extend along a center of the molding spaces while keeping both side portions of the core respectively projected into the molding spaces, joining the mold members of the mold to each other so as to hold the core fixed on mating surfaces of the mold members to keep both sides of the core floated in the molding spaces. The method further includes the step of injecting a molten molding material into the molding spaces.

Further, in accordance with this aspect of the present invention, a method for molding an arm for an elastic doll is provided. The method includes the step of forming a molding space for molding a portion of the arm extending from a shoulder of the arm to a hand thereof in a mold. The shoulder of the arm is provided with an engagement groove adapted to be engaged with a trunk of a doll. The method also includes the steps of arranging a metal core in the molding space so as to extend along a center of the molding space and holding the core at a predetermined position in the molding space by a holding means. The method further includes the step of arranging a support rod at a site in the molding space corresponding to the engagement groove. The support rod functions to support the core against an injection pressure of a molding material during molding of the arm. The method includes the step of injecting the molten molding material melted into the molding space.

It is preferable that the shoulder of the arm be provided with an engagement groove adapted to be engaged with a trunk of a doll. The method further includes the step of arranging a support rod at a site in the molding space corresponding to the engagement groove. The support rod functions to support the core against an injection pressure of a molding material during molding of the arm.

It is preferable that the method further include the steps of separating the mold members from each other after molding of the arms and removing a portion of the core exposed from the shoulder of each of the arms.

In accordance with a further aspect of the present invention, a mold for insert molding of arms for an elastic doll is provided. The mold includes first and second split mold members, which are formed therein with molding spaces each having a configuration corresponding to a configuration of a portion of each of the arms extending from a shoulder of the arm to a hand thereof, respectively. The molding spaces of the first and second split mold members are formed opposite to each other while being spaced at an interval from each other to permit proximal sections thereof which respectively correspond to proximal portions of the shoulders of the arms to face each other. The first and second split mold members have mating surfaces. The mold also includes a fixing means for fixing a metal core for connecting both arms to each other. The fixing means is formed on the mating surfaces between the molding spaces.

It is preferable that the fixing means be constituted by a recess for receiving the core therein and constructed so as to fix the core at three points.

It is preferable that the core have a bent section arranged between the molding spaces of each of the first and second split mold members, and the fixing means include a projection provided on one of the first and second split mold members so as to be engaged with the bent section of the core.

It is preferable that the fixing means further include a pair of second projections arranged at each of a plurality of positions on the one of the first and second split mold members, wherein each pair of the second projections are arranged to interposingly hold opposite sides of the core therebetween.

It is preferable that each of the arms be provided at the shoulder thereof with an engagement groove adapted to be engaged with a trunk of a doll, and the mold further include a support rod for supporting the core against an injection pressure of a molding material during molding of the arms, wherein the support rod is arranged at a site in each of the molding spaces corresponding to the engagement groove.

It is preferable that the mating surface of one of the first and second split mold members be provided thereon with a temporary holding means for temporarily holding the core thereon.

It is preferable that the mold further include a pin member for forcing out the core from the molding spaces after molding of the arms, which pin member is arranged so as to be permitted to retractably project from the mating surface of one of the first and second split mold members.

BRIEF DESCRIPTION OF DRAWINGS

FIGS. 1A and 1B each show a mold for insert molding which is used for forming an arm for an elastic doll according to the present invention by way of example, wherein FIG. 1A is a plan view showing one of split mold members and FIG. 1B is a side elevation view in section showing the mold;

BEST MODES FOR CARRYING OUT INVENTION

Now, the present invention will be described in connection with embodiments thereof with reference to the accompanying drawings.

Figure 1B:
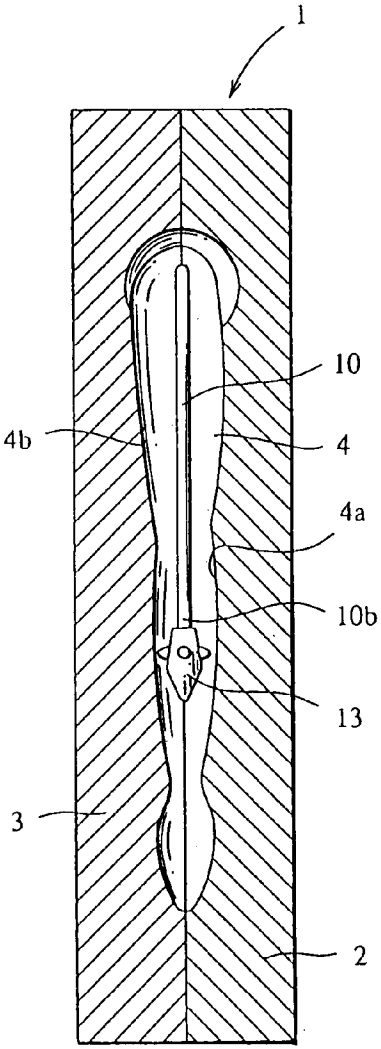
Figure 1A:
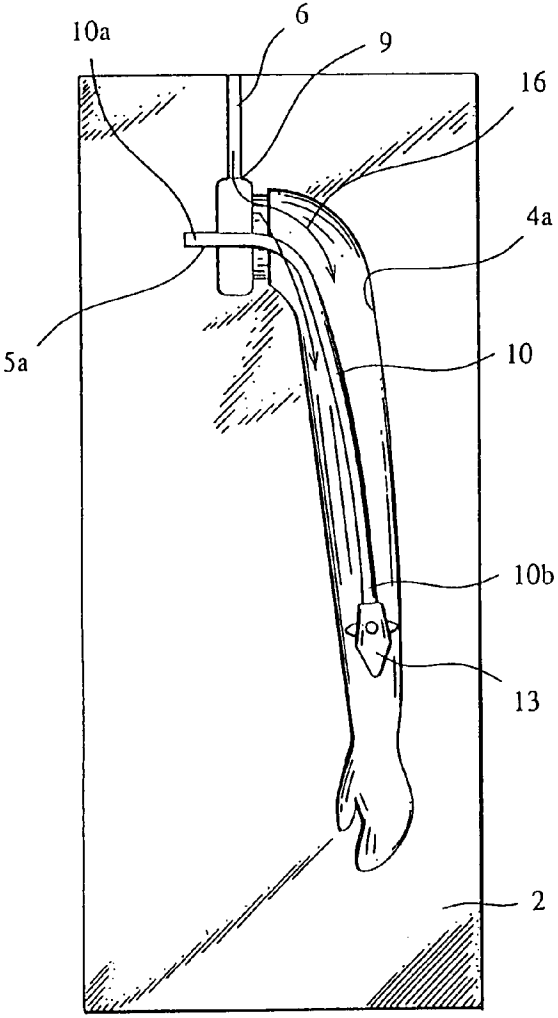

Referring first to FIGS. 1A to 5, an embodiment of each of an arm for an elastic doll and a method for forming the same according to the present invention are illustrated. FIGS. 1A and 1B show a mold for insert molding which is used for molding an arm for an elastic doll according to the present invention by way of example.

A mold generally designated by reference numeral 1 includes split mold members 2 and 3 separatably joinable to each other. The mold members 2 and 3 are formed therein with a molding space 4*a* and a molding space 4*b* so as to form a pair in cooperation with each other, respectively. The molding spaces 4*a* and 4*b* are formed so as to be substantially symmetric and constructed so as to cooperate with each other to form an arm therein by molding. The mold members 2 and 3 are matedly joined to each other, so that a molten synthetic resin material is injected into the mold 1 through an injection port 6 of the mold 1, resulting in an arm being formed by molding.

The mold 1 is formed with a gate section 9 in a manner to be contiguous to the injection port 6. Also, the gate section 9 is formed so as to be open to a portion of each of the molding spaces 4*a* and 4*b* which corresponds to a shoulder of the arm to be molded. Such arrangement of the injection port 6 and gate section 9 permits resin fed through the injection port 6 to be injected from the gate section 9 into the molding spaces 4*a* and 4*b*.

The split mold members 2 and 3 have mating surfaces defined at a position thereof between the molding spaces 4*a* and 4*b*, respectively. The mating surfaces are each formed with a recess 5*a*. The recesses 5*a* cooperate with each other to act as a fixing unit for stationarily holding one end 10*a* of a metal core 10 projected from the molding spaces 4*a* and 4*b* therein. For this purpose, the recesses 5*a* are formed to have a size which permits the core 10 to be closely fitted therein. Thus, when the mold member 2 is jointed to the mold member 3, the one end 10*a* of the core 10 which is positioned on the mold member 2 is fitted in the recesses 5*a* of the mold members 2 and 3 while being pressedly held therebetween.

Figure 2:
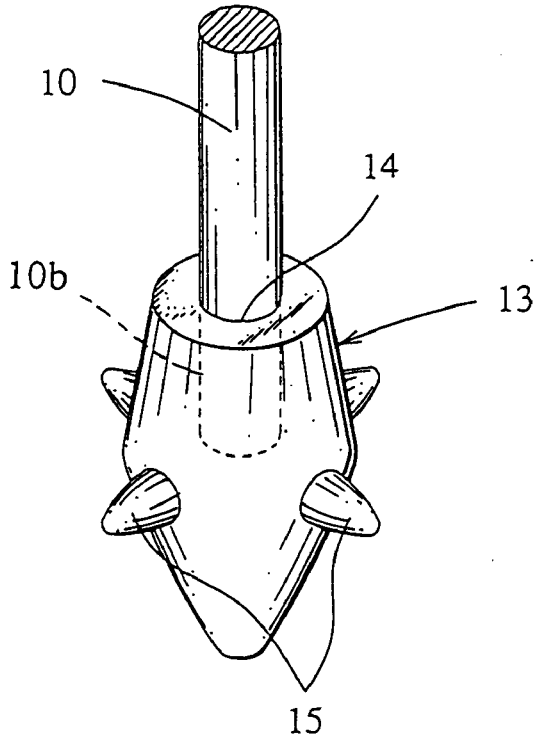
FIG. 2 is a perspective view showing an end of a core having a spacer mounted thereon.
Figure 3:
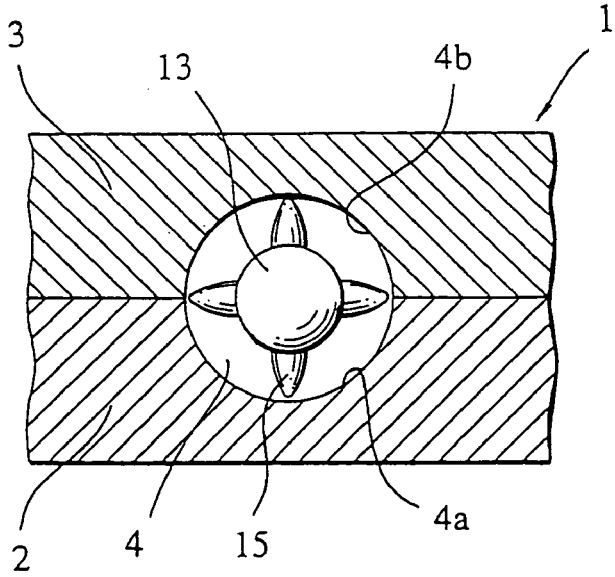
FIG. 3 is a sectional view showing a portion of the mold having the spacer arranged therein.
Figure 4C:
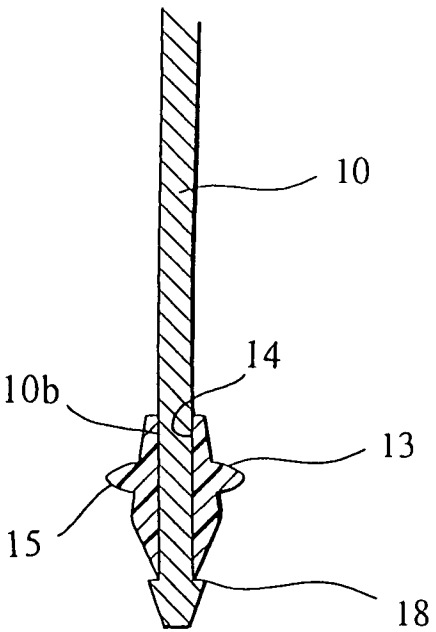
FIGS. 4A to 4C are sectional views each showing a detachment preventing section for preventing detachment of the spacer from the core.
Figure 4B:
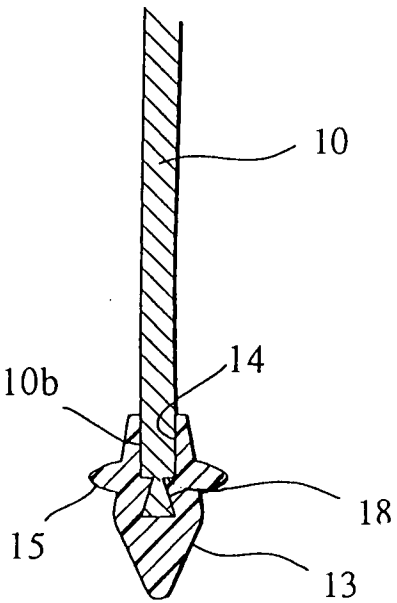
Figure 4A:
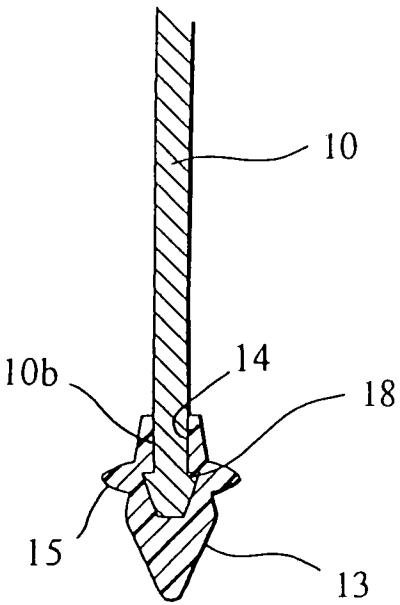

Now, molding of an arm for an elastic doll by means of the mold 1 constructed as described above will be described. First, the metal core 10 is arranged on the mold member 2. The core 10 is made of metal such as iron or the like and has a spacer 13 provided on a portion thereof in proximity to a distal end 10*b* thereof, as shown in FIG. 2. The spacer 13 is made of a resin material and formed to have a cannonball-like shape. The spacer 13 is formed at a central portion thereof with a hole 14 into which the distal end 10*b* of the core 10 is inserted. Also, the spacer 13 is formed on a peripheral surface thereof with a plurality of tapered projections 15 in a manner to extend therefrom in a radial direction perpendicular to the hole 14. The projections 15 are each preferably formed at a distal end thereof to have a diameter of about 0.1 mm to 1 mm. The core 10, as shown in FIG. 4A, is formed at the distal end thereof with detachment-preventing sections 18 which act to prevent the spacer 13 from being detached from the core 10. A plurality of such detachment-preventing sections 18 are preferably arranged at predetermined intervals on a peripheral surface of the core 10, to thereby act also as a rotation-preventing means which prevents the spacer 13 from rotating around the core 10. The detachment-preventing section 18 may be formed to have a frust-conical shape as shown in FIG. 4B. Alternatively, the detachment-preventing section 18 may be configured so as to project from the spacer 13 as shown in FIG. 4C. Further, the detachment-preventing section and the rotation-preventing means may be formed separately.

The spacer 13 is made of a synthetic resin material which is compatible with the molding material injected into the molding spaces 4*a* and 4*b* and has a melting point equal to or below a molding temperature of the molding material injected into the molding spaces 4*a* and 4*b*. For example, in the illustrated embodiment, the molding material injected into the molding spaces 4*a* and 4*b* may be a thermoplastic elastomer which has a melting point of between 100° C. and 170° C., whereas the spacer 13 may be made of polyethylene which has a melting point between 100° C. and 130° C. A temperature difference between a molding temperature of the molding material and a melting point of the spacer may be between 0° C. and 100° C. Alternatively, the spacer 13 may be made of soft or flexible synthetic resin such as an elastomer, a material designated by EVERFLEX (trademark), PVC or the like which is of the same type as the molding material. Of course, a variety of elastomers such as an olefin elastomer, an urethane elastomer and the like may each be used as the molding material. A different molding material and a different material for the spacer may be used. Of course, this may lead to a variation in the molding temperature and melting point.

Then, when the mold member 3 is superimposed on the mold member 2 alignedly or while being aligned with each other, the one end 10*a* of the core 10 is closely fitted in the recesses 5*a* of the mold members 2 and 3, so that the core 10 may be stationarily held at a center in the molding spaces 4*a* and 4*b*. Also, the other end 10*b* of the core 10 is likewise held at a center in the molding spaces 4*a* and 4*b* because the projections 15 are abutted at a distal end thereof against an inner surface of the molding spaces 4*a* and 4*b* (see FIG. 3).

Then, molten resin 16 is injected through the injection port 6 (FIG. 1A) into the molding spaces 4*a* and 4*b*. The resin is injected from the gate section 9, so that the molding spaces 4*a* and 4*b* may be filled with the resin. At this time, the core 10 has a pressure under which the resin is injected applied thereto in various directions. However, the core 10 is stably held in the molding spaces 4*a* and 4*b* because the one end 10*a* of the core 10 is firmly held in the recesses 5*a* of the mold members 2 and 3 and the other end 10*b* of the core 10 is held in the molding spaces 4*a* and 4*b* while being spaced at a predetermined interval from the inner surface of the molding spaces 4*a* and 4*b* by the spacer 13. This permits the core 10 to be firmly held at a predetermined position in the molding spaces without moving therein during the molding operation.

Figure 5:
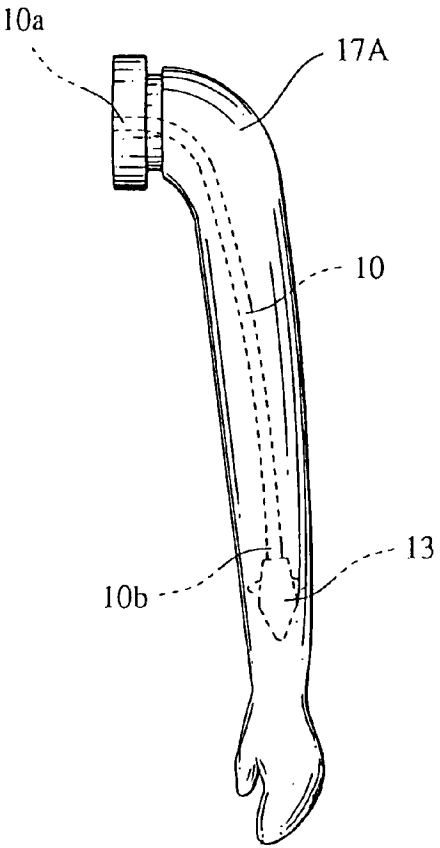
FIG. 5 is a front elevation view showing an embodiment of an arm for an elastic doll according to the present invention.

After the molding material is thus filled in the molding spaces 4*a* and 4*b*, the mold member 2 is separated from the mold member 3, resulting in such a molded article or arm 17A as shown in FIG. 5 being removed therefrom.

The material for the spacer 13 has a melting point equal to or below a molding temperature of the molding material, so that injection of the molding material into the molding spaces permits the spacer 13 to be melted gradually from the projections 15. However, the spacer 13 is prevented from being instantaneously increased in temperature to a melting point thereof. Melting of the spacer 13 is started after the molding spaces 4*a* and 4*b* are filled with the molding material. Thus, the spacer 13 sufficiently prevents the core 10 from moving during the molding and starts to be melted by the molding material after the molding material is filled in the molding spaces 4*a* and 4*b*. Further, the spacer 13 is compatible with the molding material, so that both may be integrally combined together. The projections 15 are each tapered at the distal end thereof, so that the distal end of each of the projections 15 may be rapidly melted, to thereby be integral with the molding material. This, when the molded arm 17A is removed from the mold members 2 and 3, prevents the distal end of each of the projections 15 from being exposed or causing a surface of the molded arm 17A to give an observer or user an unnatural or strange feeling or impression.

Also, the molded article 17A thus obtained permits the core 10 to extend at the one end 10*a* thereof to a shoulder of the arm and to be integrated at the other 10*b* thereof with the spacer 13 by melting; so that torsional rotation of the core 10 with respect to the spacer 13 may be substantially prevented even when the molded article 17A is repeatedly bent at an elbow joint. In addition, the detachment-preventing section or sections 18 effectively prevent the core 10 from being detached from the spacer 13, not to be externally exposed, resulting in ensuring that a user safely enjoys the doll. Further, the detachment-preventing section or sections 18 permit the core 10 and spacer 13 to be integrated with each other, to thereby more effectively prevent torsional rotation of the core 10 with respect to the spacer 13, so that the arm 17A may be readily formed into any desired configuration. When the detachment-preventing section or sections 18 are constructed so as to act also as the rotation-preventing means, integration between the core 10 and spacer 13 may be further enhanced.

The term "compatible" used herein means not only properties that the molding material and the material for the spacer are fully melted together, to thereby be integral with each other, but properties that both are partially melted together to a degree sufficient to exhibit some integrity.

Further, it is not necessarily required that the spacer be provided at the distal end of the core. It may be arranged in proximity to the distal end.

Figure 6:
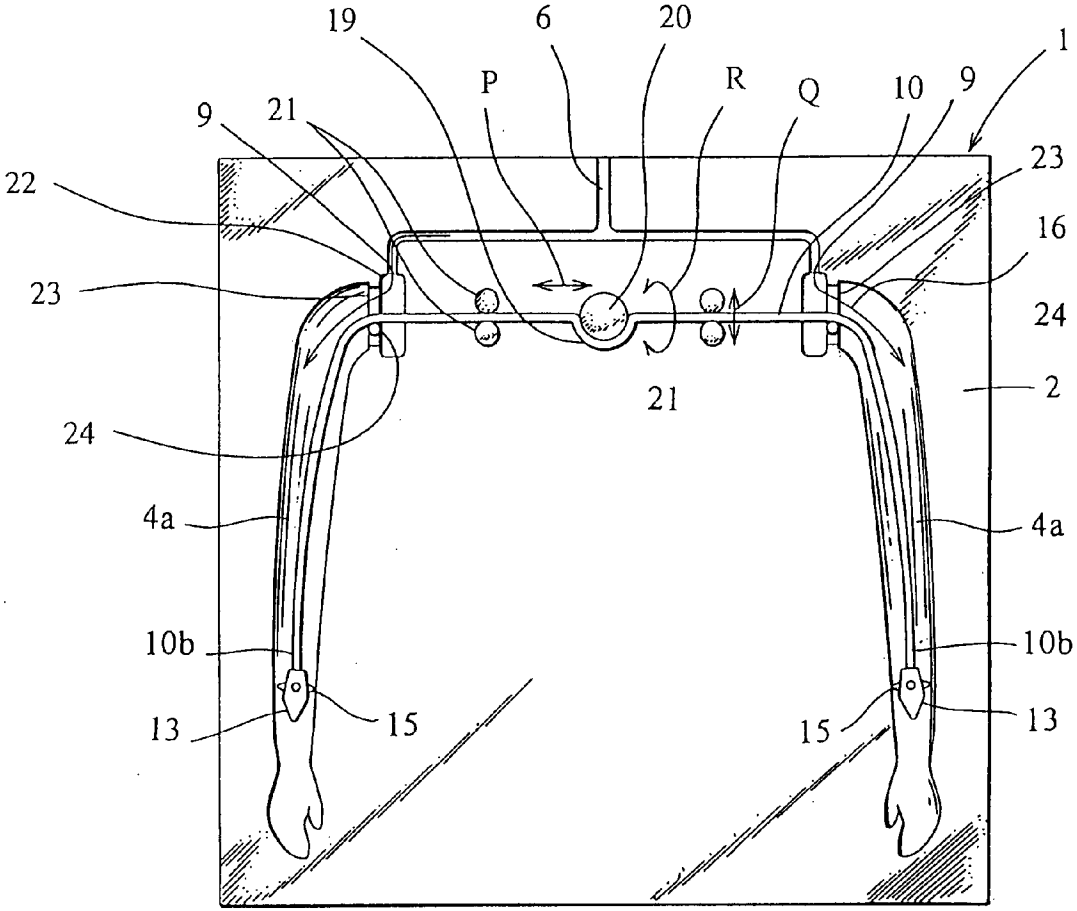
FIG. 6 is a plan view showing one of split mold members of a mold for insert molding which is used in another embodiment of a molding method according to the present invention.

Referring now to FIGS. 6 to 9, a method for molding a pair of left and right arms for an elastic doll is illustrated. A mold 1 used in the method is splittable into mold members 2 and 3. One mold member 2, as shown in FIG. 6, is formed therein with a pair of molding spaces 4*a* each constructed so as to permit a portion of each of arms for an elastic doll extending between a shoulder of the arm and a hand thereof to be molded therein. The molding spaces 4*a* and 4*a* are arranged opposite to each other while keeping proximal sections thereof which correspond to proximal portions of the shoulders of the arms facing each other. Gate sections 9 through which a molding material is injected into the molding spaces 4*a* and 4*a* are each formed at a site 22 in a respective one of the molding spaces 4*a* and 4*a* corresponding to an expanded projection formed at a proximal end of the shoulder of each of the arms.

For molding the arms, a core 10 made of metal and formed to have a laterally symmetric configuration is arranged in the molding spaces 4*a* and 4*a* in a manner to extend along a center of the molding spaces 4*a* and 4*a*. The core 10 is provided at both ends 10*b* and 10*b* thereof or portions thereof in proximity thereto with spacers 13 for holding the core 10 so as to keep it spaced at a predetermined interval from an inner surface of each of the molding spaces 4*a* and 4*a*. The core 10 is formed at a portion thereof positioned between the molding spaces 4*a* and 4*a* with a bent section 19. The spacer 13 is made of a synthetic resin material which is compatible with a molding material and has a melting point equal to or below a molding temperature of the molding material as in the embodiment described above. The core 10 is provided with detachment-preventing sections in substantially the same manner as shown in FIGS. 2 and 4A to 4C.

The mold member 2 has a mating surface having a first projection 20 and two pairs of second projections 21 and 21 formed thereon so as to act as a fixing means for fixing the core 10 between the molding spaces 4*a* and 4*a*. The first projection 20 arranged at a central position between the molding spaces 4*a* and 4*a* is formed to have a size which permits the projection to be engagedly fitted in the bent section 19 of the core 10. Each pair of the second projections 21 and 21 arranged on each of both sides of the first projection 20 are positioned so as to be engaged with the core 10 on both sides of the core 10 opposite to each other while interposing the core 10 therebetween. Engagement of the central first projection 20 with the bent section 19 of the core 10 prevents the core 10 from moving in directions indicated at arrows P in FIG. 6 and the second projections 21 and 21 on both sides prevent the core 10 from moving in directions indicated at arrows Q. Also, the central bent section 19 of the core 10 prevents the core 10 from rotating in directions of arrows R in FIG. 6. This results in the core 10 being fixedly held at a predetermined position in the mold 1.

Figure 7:
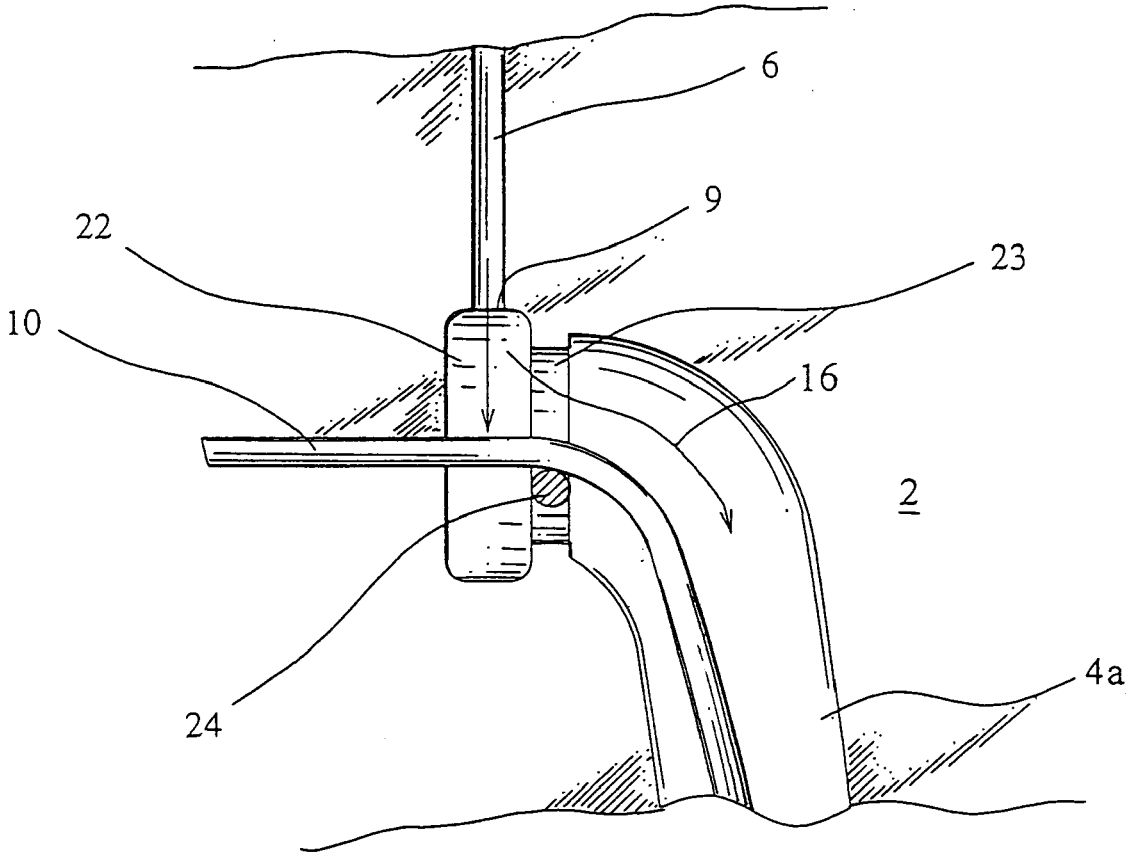
FIG. 7 is a fragmentary enlarged plan view of the split mold member shown in FIG. 6.

Also, the molding spaces 4*a* each have a site 23 arranged in correspondence to an engagement groove of the shoulder of each of the arms. The molding spaces 4*a* are each provided at a portion thereof somewhat below a center of the site 23 with a support rod 24 for supporting the core 10 in a drawable manner, as best seen in FIG. 7.

Figure 8A:
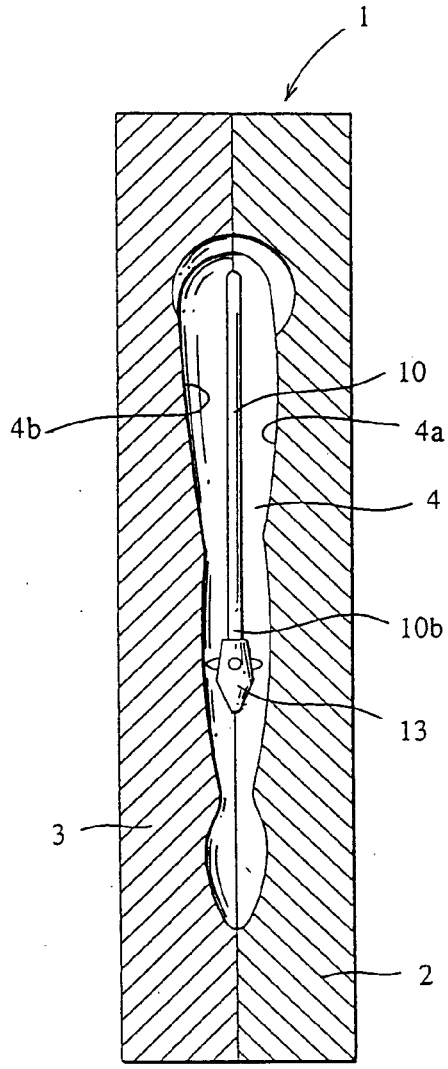
FIG. 8A is a side elevation view in section showing the mold of FIG. 6 which is kept closed.
Figure 8B:
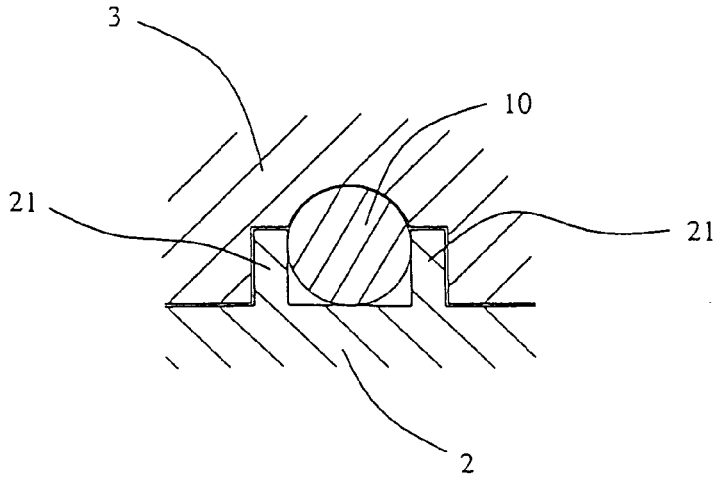
FIG. 8B is a fragmentary enlarged sectional view showing a core fixing section of the mold of FIG. 8A closed.
Figure 9:
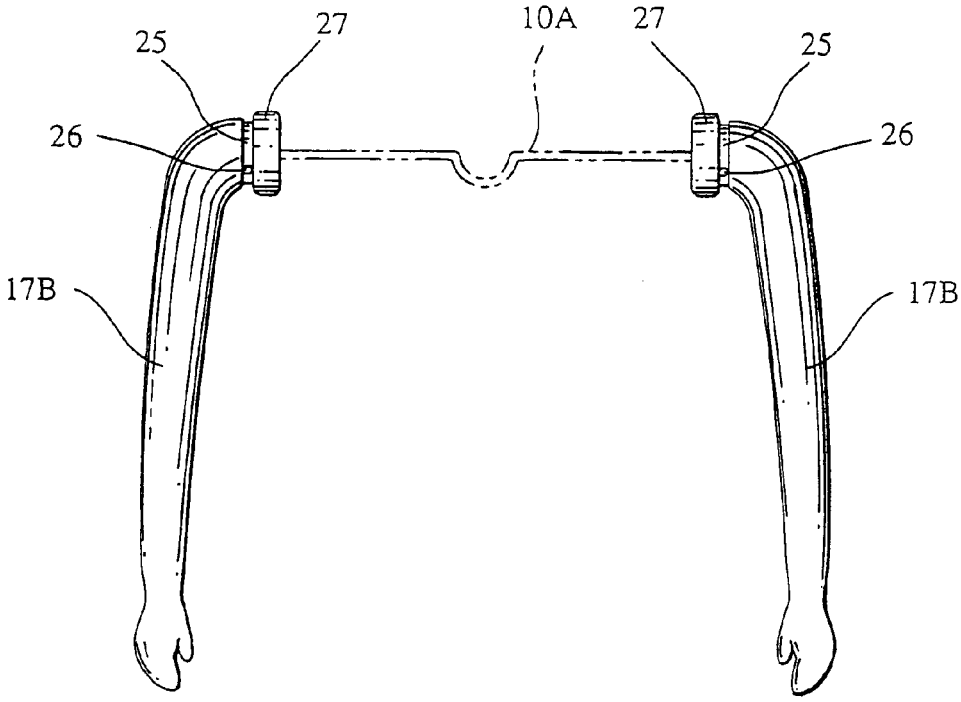
FIG. 9 is a front elevation view showing an article formed by molding using the mold shown in FIG. 6.

After the core 10 is fixedly arranged in the mold member 2, the mold members 2 and 3 are joined together as shown in FIG. 8A. At this time, the second projections 21 and 21 and the core 10 are joined to or engaged with each other as shown in FIG. 8B. (Engagement between the core 10 and the first projection 20 is carried out in substantially the same manner.) Then, a molding material (molten resin) 16 is injected from an injection port 6 into the molding spaces 4 in substantially the same way as in the embodiment described above. An injection pressure of the molding material is applied directly to a section of the core 10 corresponding to a shoulder of each of arms to be molded, to thereby be increased, so that the core 10 is downwardly forced on the plane of each of FIGS. 6 and 7. In this instance, the core 10 is supported from the side opposite to the direction of injection or upwardly by the support rod 24, resulting in stability of the core 10 being further enhanced. Likewise, the injection pressure of the resin is applied to the core 10 in the molding spaces 4 in various directions. However, a central region of a portion of the core 10 outwardly projected from the molding spaces 4 is firmly held by the first and second projections 20 and 21 arranged on the mating surfaces of the mold members 2 and 3. Also, the ends 10*b* of the core 10 are held by the spacers 13 so as to be spaced at a predetermined interval from the inner surface of the molding spaces 4, so that the whole core 10 may be stably supported without moving in the molding spaces 4.

After the molding material is charged into the molding spaces, the mold members 2 and 3 are separated from each other and the support rods 24 are drawn out of the molding spaces 4, so that molded articles (arms) 17B may be taken out of the mold members 2 and 3. The core 10 is removed at an exposed portion 10A thereof by cutting. The molded article 17B is formed at an engagement groove 25 with a hole 26 by drawing out the support rod 24 from the molded article. The engagement groove 25 is adapted to be engagedly fitted in a hole (not shown) on a side of a trunk of a doll together with an expanded projection 27. This keeps the hole 26 from being externally exposed when the molded arm is attached to the trunk, to thereby prevent a deterioration in appearance of the arms and therefore the doll.

In the method of the illustrated embodiment, the material for the spacers 13 has a melting point equal to or below a molding temperature of the molding material and compatible with the molding material, so that both may be rendered integral with each other. This prevents the projections 15 from being exposed at the distal end thereof from a surface of the molded article or arm 17B and the distal end of each of the projections 15 from giving a user an unnatural or strange feeling or impression. Also, when the spacer 13 is kept fixed on the core 10, the core 10 is integrated with the spacer 13 and a skin/flesh member constituted by the molding material, so that repeating of bending of the molded article or arm 17B does not cause torsional rotation of the core 10. This permits the molded arm to be formed to have any desired configuration and prevents the core 10 from being detached from the spacer 13, to thereby be externally exposed, resulting in it ensuring that a user may safely enjoy the doll.

The support rods 24 function to prevent the core 10 from being moved by an injection pressure of the molding material. Thus, it is not necessarily required that the support rods 24 be arranged together with the first and second projections 20 and 21 and the spacers 13 as described above. Also, it is merely required that the core 10 be held at a predetermined position in the molding spaces 4 using any suitable means. Likewise, when the core 10 is held by a combination of the first and second projections 20 and 21 with the spacers 13, the support rods 24 are not necessarily required. Nevertheless, arrangement of the support rods 24 ensures more effective holding of the metal core 10 in the molding spaces.

Figure 10:
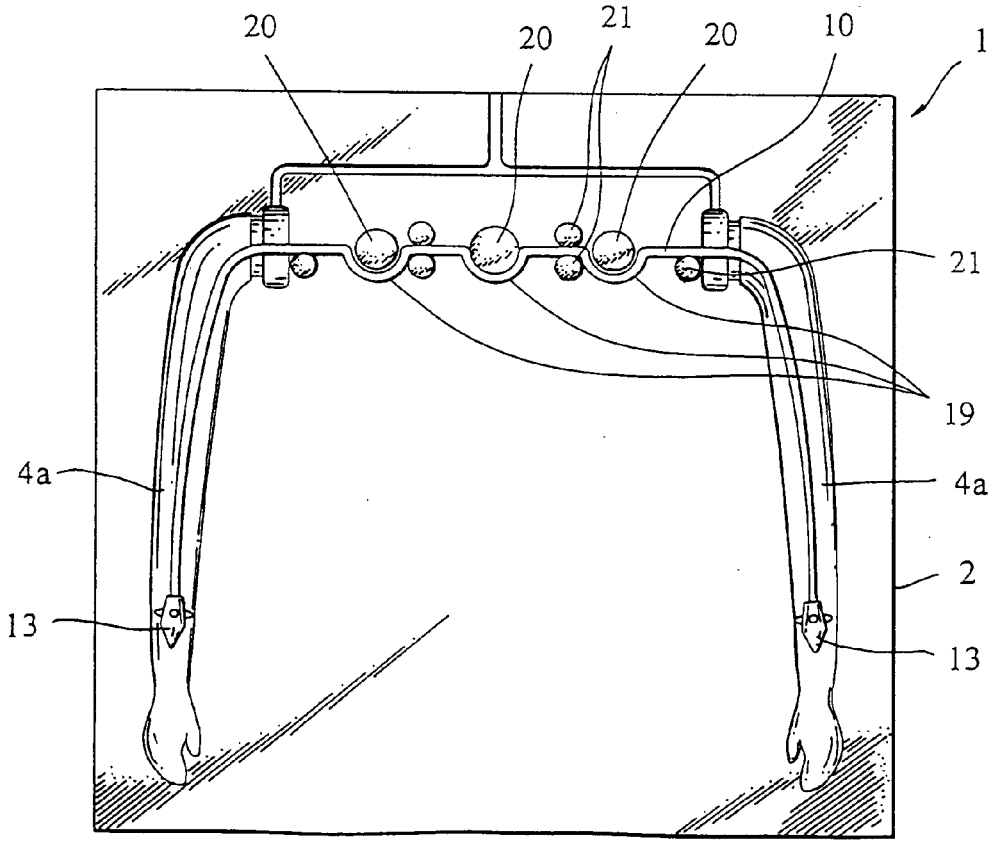
FIG. 10 is a plan view showing one of split mold members in which a core is fixed in another manner.

Referring now to FIG. 10, a modification of a fixing means for securely holding the core 10 in the molding spaces is illustrated. The modification may be so constructed that a core 10 is provided with a plurality of bent sections 19 and correspondingly a mold member 2 is provided with a plurality of first projections 20. The bent portions 19 are each not necessarily limited to an arcuate configuration as shown in FIG. 10. For example, the bent portions 19 may each be formed to have any other suitable configuration such as a shape as shown in FIG. 11 described hereinafter, a V-shape, a U-shape, a sharp-cornered U-shape or the like.

Figure 11:
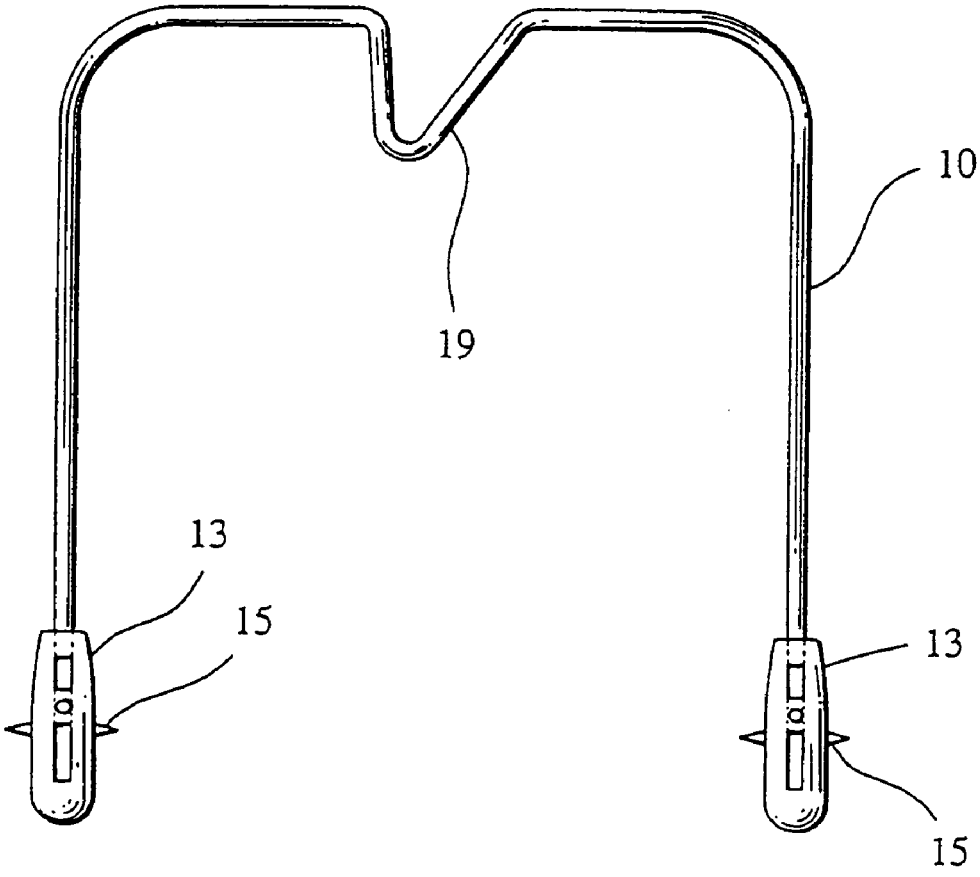
FIG. 11 is a front elevation view showing another example of a core which is constituted by a metal core member and spacers.
Figure 12:
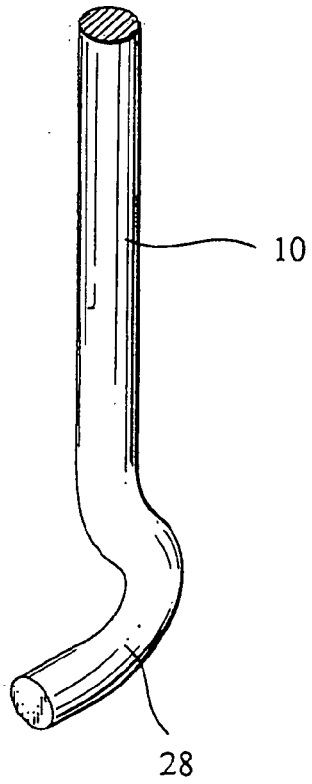
FIG. 12 is an enlarged exploded perspective view showing a part of the core of FIG. 11.
Figure 12:
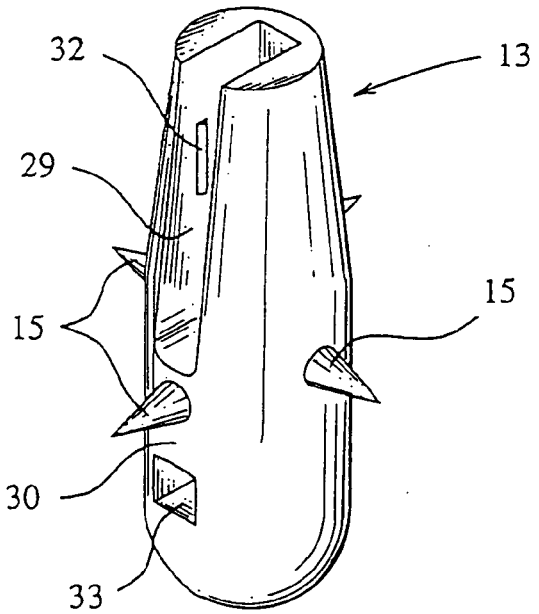
Figure 13:
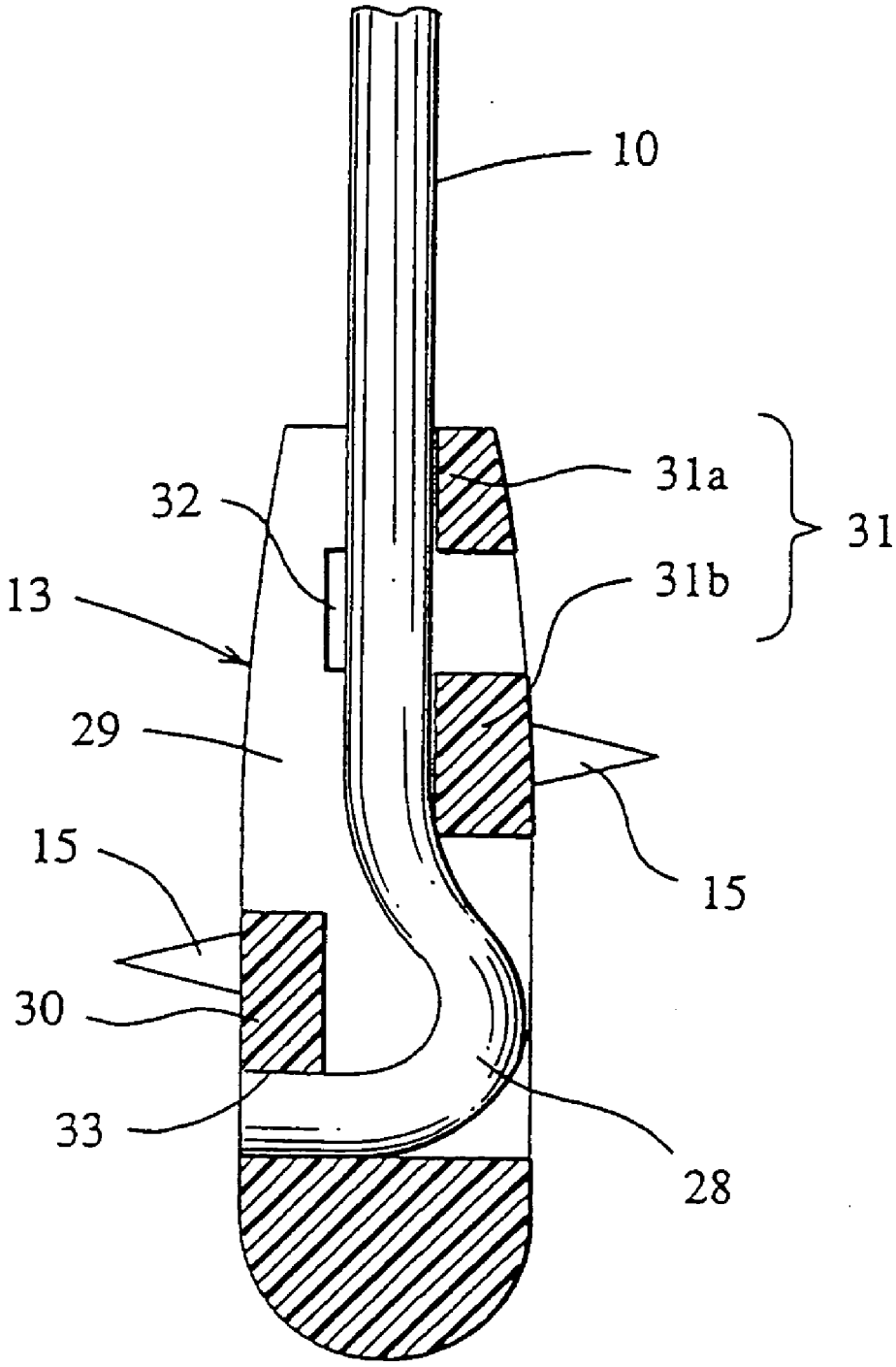
FIG. 13 is an enlarged vertical sectional view of the core member and spacer shown in FIG. 11.

Referring now to FIGS. 11 to 13, another modification of the core and spacers is illustrated. A core 10 of the illustrated modification is made of metal and formed at a central portion thereof with a bent section 19 of a modified V-shape which permits a front side of the core and a rear side thereof to be readily discriminated from each other. Also, the core 10 is provided on each of both distal ends thereof with a bent section 28 of an arcuate shape, as shown in FIGS. 12 and 13. Alternatively, the bent sections 28 may each be formed to have a V-shape, a sharp-cornered U-shape or the like.

The spacers 13, as shown in FIGS. 12 and 13, are each formed to have a substantially cylindrical or columnar shape. Also, the spacer 13 is formed with a groove 29 which has a width substantially equal to a diameter of the core 10 and is open to a front side surface of the spacer 13, a rear side surface thereof and an upper surface thereof, so that the spacer 13 may include a front lower wall 30 positioned below the groove 29 and a rear upper wall 31 positioned behind the groove 29. The front lower wall 30 of the spacer 13 is formed with an engagement hole 33. Also, the groove 29 is formed to be open to the rear side surface of the spacer in a manner to permit the rear upper wall 31 to be divided into an upper section 31*a* and a lower section 31*b* vertically spaced from each other. The groove 29 is provided on each of both lateral inner surfaces thereof with a projection 32 of a triangular shape in section. An interval between both projections 32 is defined to be smaller than a diameter of the core 10. Also, the spacer 13 is provided on an outer peripheral surface thereof with four projections 15 in a manner to radially extend therefrom. Thus, the projections 15 include two front and rear projections opposite to each other and two lateral projections opposite to each other. The projections 15 are not arranged at the same level or height on the peripheral surface. However, the projections 15 permit the spacer 13 in the illustrated modification to exhibit the same interval holding function as the spacer 13 described above with reference to FIG. 2. Also, the front and rear projections 15 are positioned on a diagonal line, to thereby prevent the core 10 from moving back forth in the mold.

Mounting of the thus-constructed spacer 13 on each of the distal ends of the core 10 is carried out by inserting the bent section 28 formed at the distal end of the core 10 into the groove 29 from a front side of the groove 29 and then rotating the spacer 13 to engagedly fit a distal end of the bent section 28 in the engagement hole 33 of the front lower wall 30 and to abut a portion of the core 10 above the bent section 28 against the rear upper wall 31 beyond the projections 32.

After the spacer 13 is thus mounted on the core 10, the distal end of the bent section 28 of the core 10 is kept fitted in the engagement hole 33, to thereby substantially prevent the core 10 from being detached from the spacer 13. Also, a straight portion of the core 10 right above the bent section 28 is held between the rear upper wall 31 of the spacer 13 and the projections 32, to thereby substantially prevent or restrain the spacer 13 from rotating in a direction opposite to that in which the spacer 13 is mounted on the core 10. This prevents the spacer 13 from being detached from the core 10 due to application of an injection pressure of the molding material to the core 10 during a molding operation.

The core 10 of the illustrated modification constructed as described above is bent at the distal end thereof as indicated by reference numeral 28. Such arrangement of the bent section 28 at the distal end effectively restrains the distal end of the core 10 from being projected from the molding material after molding of the arm. Even if it is projected therefrom, it is highly safe to the human body as compared with the case that the distal end is straightly projected.

Also, the spacer 13 is formed with the groove and holes, to thereby be highly increased in surface area. This permits an increase in contact surface between the molding material and the spacer 13 when the molding material is injected into the molding space during the molding operation, so that both may be melted with each other, to thereby be readily integrated with each other.

Figure 14:
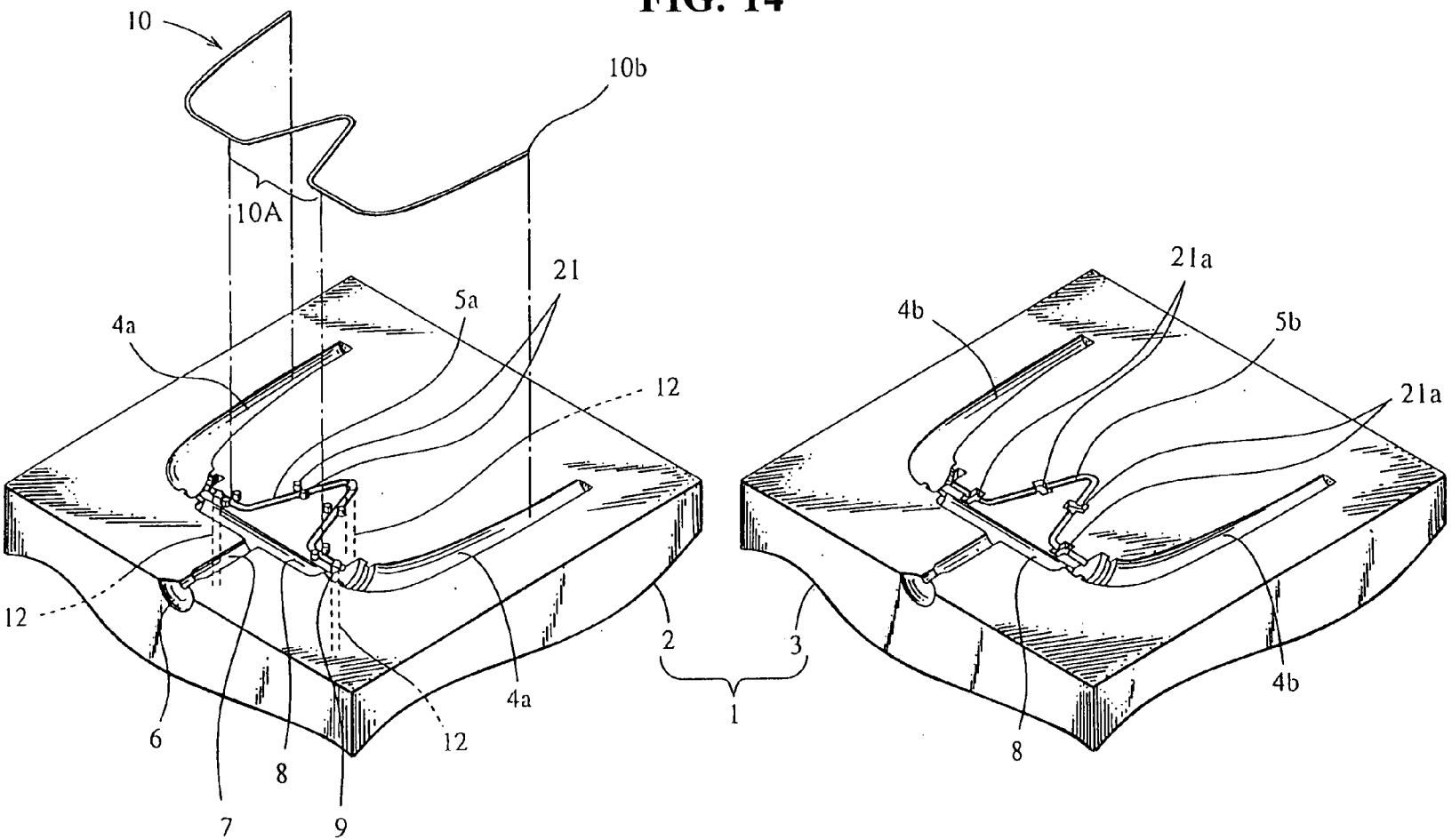
FIG. 14 is a perspective view showing a mold for molding arms for an elastic doll according to the present invention.

Referring now to FIGS. 14 to 16B, another embodiment of a method for molding arms for an elastic doll according to the present invention and a mold used in the method are illustrated. In FIG. 14, reference numeral 1 designates a mold for insert molding (hereinafter referred to as "mold"). The mold is used for molding arms for an elastic doll.

The mold 1 is constituted by first and second split mold members or a fixed mold member 2 and a movable mold member 3. The fixed mold member 2 is symmetrically formed with a pair of molding spaces 4*a* and 4*a* and correspondingly the movable mold member 3 is symmetrically formed with a pair of molding spaces 4*b* and 4*b*. The fixed mold member 2 and movable mold member 3 are joined to each other and then a molten synthetic resin material is injected through an injection port 6 into the molding spaces, to thereby form arms. The molding spaces 4*a* and 4*a* are so formed that proximal sections thereof corresponding to proximal portions of the arms are arranged opposite to each other while being spaced at a predetermined interval from each other. This is likewise true of the molding spaces 4*b* and 4*b*.

The fixed mold member 2 and movable mold member 3 have mating surfaces which are formed thereon with grooves 5*a* and 5*b* of a substantially V-shape between the molding spaces 4*a* and between the molding spaces 4*b*, respectively. The grooves 5*a* and 5*b* each act as a fixing unit for fixing a fixed portion 10A of a central region of a metal core 10 projected from the molding spaces 4*a*, 4*a* and 4*b*, 4*b*. For this purpose, the grooves 5*a* and 5*b* are each formed to have a size which permits the core 10 to be closely or tightly fitted therein; so that when the movable mold member 3 is joined to the fixed mold member 2, the core 10 positioned on the fixed mold member 2 may be received in the grooves 5*a* and 5*b*, to thereby be firmly held between the fixed mold member 2 and the movable mold member 3.

The fixed mold member 2 is formed thereon with a plurality of pairs of temporary holding projections 21, which are arranged along the groove 5*a* and in proximity thereto. Also, each pair of the temporary holding projections 21 are arranged in a manner to interpose the groove 5*a*. The temporary holding projections 21 function to temporarily hold the metal core 10 which is kept fitted in the groove 5*a* of the fixed mold member 2. The movable mold member 3 is provided thereon with recesses 21*a* in a manner to positionally correspond to the temporary holding projections 21.

Figure 15:
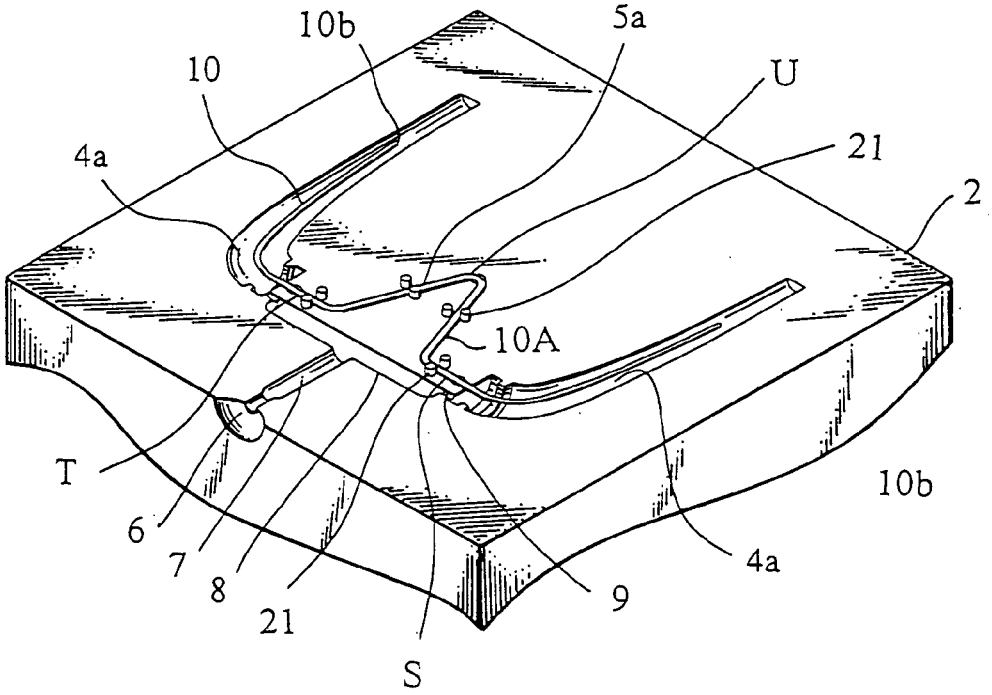
FIG. 15 is a perspective view of the mold shown in FIG. 14 which has a core set therein.

Also, the fixed mold member 2 is provided on the mating surface thereof with pin members 12 in a manner to be projectable and retractable with respect to the groove 5*a*. The pin members 12 function to force out the metal core 10 therefrom after molding of the arms. In FIGS. 14 and 15, reference numeral 7 designates a sprue section, 8 is a runner section and 9 is a gate section.

Now, molding of arms for an elastic doll by the mold 1 of the illustrated embodiment thus constructed will be described. First, the metal core 10 for both arms is arranged on the fixed mold member 2. The core 10 is made of metal such as iron or the like and formed so as to project into both molding spaces 4*a* and 4*a*. Also, the core 10, as described above, has the central fixed portion 10A bent into a V-shape. The fixed portion 10A of the core 10, as shown in FIG. 15, is inserted between the temporary holding projections 21 of the fixed mold member 2 and fitted in the groove 5*a*, to thereby be temporarily held on the fixed mold member 2. This permits the both sides of the core 10 to be held at a central portion in the molding spaces 4*a* while horizontally extending therein. The core 10 is formed to have a length which prevents distal ends 10*b* of the core 10 from excessively approaching inner surfaces of the molding spaces 4*a* and 4*a*. The distal ends 10*b* of the core 10 may be folded back.

Then, the movable mold member 3 is joined to the fixed mold member 2 in a manner to be superposed thereon, so that the fixed portion 10A of the core 10 is closely fitted in the grooves 5*a* and 5*b* of the fixed mold member 2 and movable mold member 3. In this instance, the core 10 is prevented from being rotated about the fixed portion 10A because the fixed portion 10A of the core 10 is formed to have a V-shape. This permits the core 10 to be horizontally firmly held in the mold.

Then, a molten synthetic resin material is injected through the injection port 6 into the molding spaces 4*a* and 4*b*. The resin is fed through the sprue section 7 and runner section 8 and then injected from the gate section 9 into the molding spaces 4*a* and 4*b*. This permits the molding spaces 4*a* and 4*b* to be filled with the resin. At this time, the core 10 has an injection pressure of the resin applied thereto in various directions. However, the fixed portion 10A of the core 10 is firmly held or fixed as described above, resulting in the core 10 being prevented from moving in the molding spaces 4*a* and 4*b*. The synthetic resin material is soft or flexible synthetic resin such as an elastomer, a material designated by Everflex (trademark), PVC or the like.

Figure 16A:
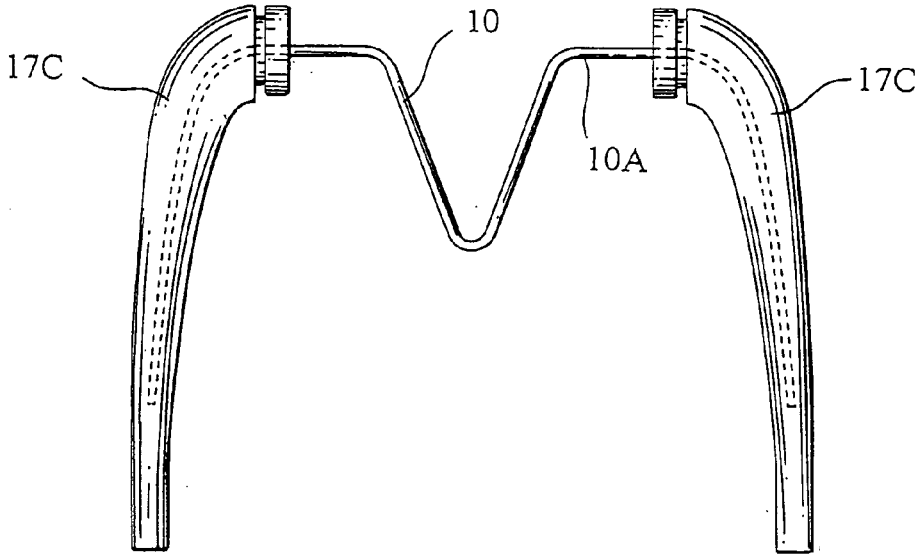
FIG. 16A is a schematic view showing an article as molded by the mold of FIG. 14.
Figure 16B:
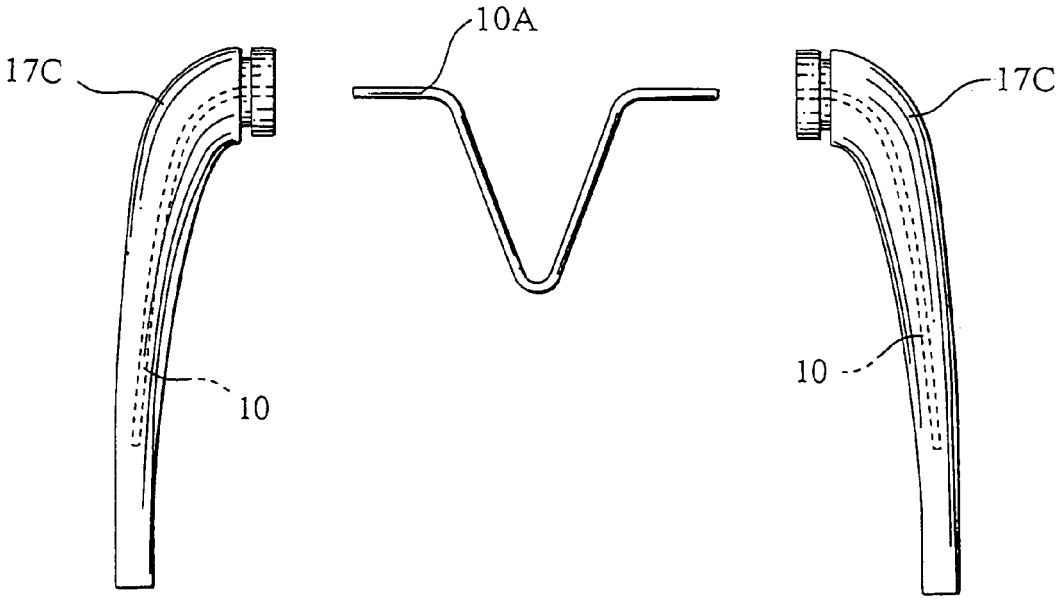
FIG. 16B is a schematic view of the molded article shown in FIG. 16A from which an excessive portion of the core is removed by cutting.
Figure 17:
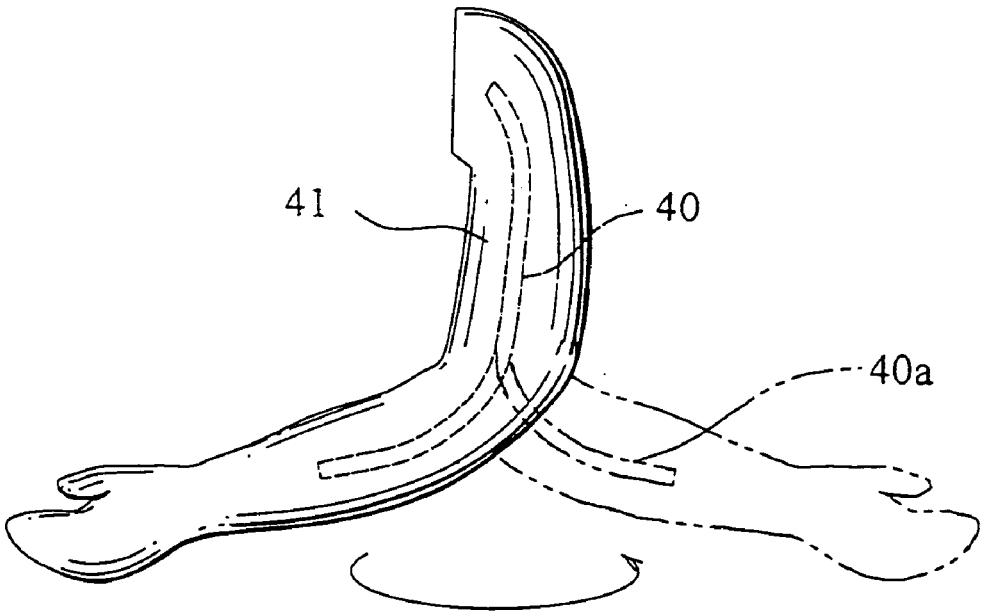
FIG. 17 is a schematic view showing a core incorporated in a conventional molded article.
Figure 18:
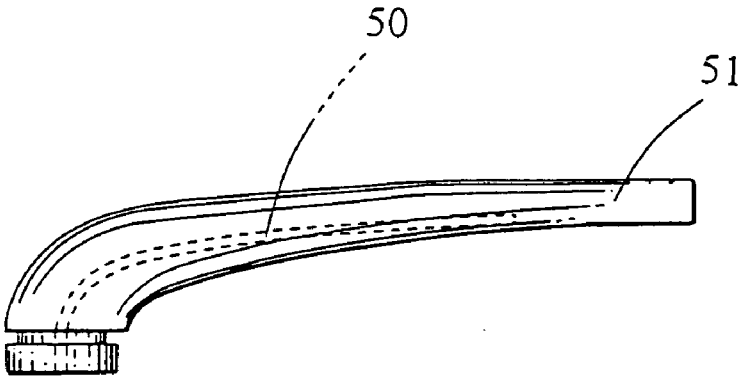
FIG. 18 is a schematic view showing a core incorporated in another conventional molded article.

After the molding spaces 4*a* and 4*b* are thus filled with the resin material, the movable mold member 3 is separated from the fixed mold member 2 and then the pin members 12 are projected therefrom, resulting in the core 10 being forced out of the fixed mold member 2 and concurrently molded articles or molded arms 17C and 17C being removed therefrom while being connected with each other through the core 10, as shown in FIG. 16A. After the removal is thus carried out, the central portion 10A of the core (a portion of the core exposed from the molded articles) which is unnecessary is cleared from the molded articles by cutting, resulting in the molded arms 17C and 17C being separated from each other.

The molded arms 17C each have the core 10 necessarily kept embedded therein while being arranged at a central position therein, resulting in production of any defects in which the core is shifted or deviated from the central position in the molded article being minimized, so that yields in the manufacturing may be improved. The molded arms each have the core 10 embedded therein, to thereby be kept bent once it is bent, resulting in it exhibiting good reliability and ensuring safety during handling thereof because the core is fixed at a central position therein.

The fixed portion 10A of the core 10 is merely required to be supported in at least three points on the mating surfaces of the fixed mold member 2 and movable mold member 3. Thus, the grooves 5*a* and 5*b* are each merely required to be so formed that portions S and T thereof positioned in proximity to the molding spaces 4*a*, 4*b* and a central bent portion U thereof may be tightly contacted with the core 10. The remaining part of each of the grooves 5*a* and 5*b* may be formed so as to permit the core 10 to be loosely fitted therein.

In relation to the above, the fixing unit is not limited to a structure in the form of a groove like the grooves 5*a* and 5*b*. For example, the fixing unit may be constructed in such a manner that the mating surface of each of the fixed mold member 2 and movable mold member 3 is formed with recesses, in which projections (not shown) for supporting the core at three points are arranged.

Also, in the illustrated embodiment, the molding spaces in the mold are formed to be identical and symmetric with each other. However, the molding spaces are not necessarily required to be identical with each other. Also, the fixed section 10A of the core 10 is not limited to a V-shape. It may be formed to have any other suitable shape such as a U-shape, a W-shape or the like.

As can be seen form the foregoing, the arm for an elastic doll of the present invention is so constructed that the metal core is provided at the distal end thereof with the spacer having a sectional area smaller than that of the arm. Such construction permits the core to be arranged at a central position in the arm and prevents torsional rotation of the core in the arm and external exposure of the spacer. Also, the spacer is made of a material which is compatible with the molding material for the arm, so that both materials may be integrated with each other during molding of the arm. This prevents the molded arm from giving a user an abnormal or unnatural feeling or impression when the user touches it, resulting in it giving a natural touch.

In one embodiment of the present invention, as described above, the spacer is provided on the peripheral surface thereof with the tapered projections. Such construction facilitates not only flowing of the molding material in the molding spaces during the molding operation but melting of the projections on the spacer.

Also, in one embodiment of the present invention, the core is provided with the detachment-preventing element for the spacer. Such construction permits the core and spacer to be rendered integral with each other, resulting in torsional rotation of the core with respect to the spacer being substantially prevented, so that the molded arm may take a desired configuration and ensure safety in handling thereof.

In one embodiment of the present invention, the core is bent at the distal end, to thereby minimize projection of the core from the molding material after molding of the arm. Also, it is highly increased in safety as compared with a core that a distal end thereof is formed to be straight, even if it is outwardly projected from the molding material. The spacer is formed with the engagement hole in which the bent section of the core is engagedly fitted, to thereby be highly increased in surface area. Such construction permits a contact surface between the molding material and the spacer to be increased when the molding material is injected into the molding spaces during the molding operation, so that the material for the spacer and the molding material may be melted together, to thereby be readily integrated with each other. Further, the distal end of the core is bent, to thereby prevent the spacer from being detached from the core by an injection pressure of the molding material applied thereto during the molding operation.

In the method for molding an arm for an elastic doll according to the present invention, the metal core is fixed at one end thereof on the proximal section of the molding space in the mold which correspond to the proximal portion of the shoulder of the arm. Also, the core is so arranged that the other end thereof or the portion thereof in proximity to the other end is kept spaced at a predetermined interval from the inner surface of the molding space. Such construction permits the core to be held at a predetermined position in the molding space while preventing the core from moving during the molding operation. Also, the material for the spacer is synthetic resin which is compatible with the molding material and has a melting point equal to or below a molding temperature of the molding material. This permits both materials to be integrated with each other, to thereby prevent the projections on the spacer from being exposed at the distal end thereof from a surface of the molded article and the distal end of each of the projections from giving a user an unnatural or strange feeling or impression. Also, the molded arm is solid and free from any cavity and has the same touch as that of a leg member having the core embedded therein, to thereby be prevented from giving a user an abnormal or strange feeling or impression. Further, the arm as well as a leg may be made by insert molding, to thereby eliminate imbalance or difference in texture or touch between the arm and the leg.

In the method for molding arms for an elastic doll according to the present invention, a pair of left and right arms can be concurrently molded. Also, in the method, the single continuous core is arranged in a pair of the molding spaces, so that the core including the bent section may be securely held by the projections of the mold formed between the molding spaces. This permits a portion of the core positioned on a shoulder side of each of the arms to be stationarily held and an end of the core on a hand side of the arm to be held at a predetermined position in the molding spaces by the spacer, so that the arms for an elastic doll in which the core is kept from being deviated may be molded. Further, the core is removed at an exposed portion thereof after the molding operation, so that the arms for an elastic doll which have the core appropriately embedded therein and exhibit stable quality may be manufactured.

In the method for molding an arm for an elastic doll according to the present invention, molding is carried out while the metal core is positively and firmly held to keep both sides of the core floated in the molding spaces. The core for a pair of arms is constituted by a single core, to thereby obviate the necessity of supporting a plurality of cores in the respective molding spaces, resulting in production efficiency being increased.

In the method for molding an arm for an elastic doll according to the present invention, the holding means is arranged so as to hold the metal core along a center in the molding space and the support rod for supporting the core against an injection pressure of the molding material during the molding operation is arranged at the site in the molding space corresponding to the engagement groove provided at the shoulder of the arm. Thus, when the molding material is injected through the site in the molding space corresponding to the shoulder of the arm into the molding space, an injection pressure of the molding material is initially substantially applied to a portion of the core positionally corresponding to the shoulder. However, the core is supported by the support rod on a side opposite to that on which the pressure is applied thereto, so that it may be stably held without moving in the molding space. Also, after the support rod is drawn out of the engagement groove of the molded arm, a hole is left in the groove. However, the hole cannot be externally observed, because connection of the arm to a trunk of a doll permits the engagement groove to be out of sight. This prevents a deterioration in appearance of the arm.

The mold for insert molding of an arm for an elastic doll according to the present invention is so constructed that the first split mold member (fixed mold member) and second split mold member (movable mold member) are each formed therein with molding spaces each having a configuration corresponding to a configuration of a portion of each of a pair of left and right arms extending from a shoulder of the arm to a hand thereof, respectively. Also, the single continuous metal core is arranged between the molding spaces of the mold members. Then, the core is firmly held at a central portion thereof by the fixing means formed on the mating surfaces of the mold members. Such construction permits the core to be firmly supported in the molding spaces, to thereby be stationarily held at a predetermined position therein during the molding operation while permitting the mold to be simplified in structure. Thus, the mold of the present invention provides arms for an elastic doll in each of which the core is appropriately embedded and which exhibit stable quality. Also, the molded arms are each solid and free from a cavity and give the same touch as that of a leg member having the core embedded therein, to thereby be prevented from giving a user an abnormal or strange feeling or impression.

In one embodiment of the present invention, the fixing means for fixing the metal core may be constituted by the grooves formed on the mold members. This merely requires processing of the mold, resulting in arrangement of any additional member being eliminated, leading to a reduction in manufacturing cost thereof. The metal core received in the grooves is fixed at at least three points, resulting in it being firmly supported in the grooves.

Further, one embodiment of the present invention is so configured that the metal core is temporarily held on the fixed mold member using the temporary holding means. This facilitates joining of the movable mold member to the fixed mold member in a superposed manner.

Moreover, one embodiment of the present invention permits the molded article to be forced out of the molding spaces together with the metal core, so that removal of the molded article from the mold may be facilitated.

What is claimed is:

1. A method for molding an arm for an elastic doll, comprising the steps of:

forming a molding space for molding a portion of the arm extending from a shoulder thereof to a hand thereof in a mold;

arranging a metal core in said molding space so as to extend along a center of said molding space, said core being fixed at one end thereof in a proximal section of said molding space which corresponds to a proximal portion of the shoulder of the arm, said core being provided at another distal end thereof or a portion thereof positioned in proximity to the another distal end with a spacer for keeping said core spaced at a predetermined radial interval from an annular inner surface of said molding space, and the distal end of the metal core is spaced in a lengthwise direction from a distal end of the molding space adjacent the molding space which corresponds to a hand of the arm; and injecting a molten molding material into said molding space at a molding temperature to melt the spacer so that the spacer becomes integral with the molten molding material;

said spacer being made of a synthetic resin material which is compatible with said molding material and has a melting point equal to or below the molding temperature of said molding material.

2. A method for molding arms for an elastic doll, comprising the steps of:

forming a pair of molding spaces for molding portions of arms, each, extending from a shoulder of an arm to a hand thereof in a mold including mold members, said molding spaces being formed opposite to each other to permit proximal sections thereof which respectively correspond to proximal portions of the shoulder of each of the arms to face each other;

arranging a metal core in said molding spaces so as to continuously extend along a center of said molding spaces; said metal core being provided at each of distal ends thereof or a portion thereof positioned in proximity to the distal end with a non-movable spacer for keeping said metal core at a radial predetermined interval from the encircling inner surfaces of said molding spaces, the respective distal ends of each molding spaces is spaced from the distal ends of the molding spaces adjacent the molding spaces which correspond to a hand of the arm;

injecting a molten molding material into said molding spaces at a molding temperature to melt the spacer;

said metal core being fixed at an exterior portion thereof positioned between said molding spaces with a bent section;

said mold members having respective mating surfaces, one of which is formed thereon with projections engaged with said bent section of said metal core and opposite sides of said metal core to stationarily hold said metal core;

said spacer being made of a synthetic resin material which is compatible with said molding material and has a melting point equal to or below the molding temperature of said molding material;

melting the spacer to integrate the spacer material with the molding material;

removing the pair of molded arms from the molding spaces; and removing the bent section of the metal core to disconnect the molded arms from each other.

3. A method for molding arms for an elastic doll, comprising the steps of:

forming a pair of molding spaces for molding portions of arms, each extending from a shoulder of an arm to a hand thereof in a mold including mold members, said molding spaces being formed opposite to each other to permit proximal sections thereof which respectively correspond to proximal portions of each shoulder of each of the arms to face each other;

providing a single metal core of a laterally symmetric configuration;

attaching a pair of spacers of a synthetic resin material to the metal core, each respective spacer is affixed adjacent an end of the metal core in a non-movable manner;

arranging said metal core in said molding spaces so as to continuously extend along a center of said molding spaces while keeping both side portions of said core respectively projected into said molding spaces, with the assistance of said spaces;

securing a portion of said metal core at a location between said pair of molding spaces;

joining said molding members of said mold to each other so as to hold said metal core fixed on mating surfaces of said mold members to keep both sides of said core floated in said molding spaces;

injecting a molten molding material into said molding spaces, the synthetic resin material is compatible with said molding material and has a melting point equal to or below a molding temperature of said molding material, said spacers of a size and configuration not to move by an injection pressure during the injection of the molding material and to subsequently melt and become integral with the molding material;

permitting the arms to form; and cutting said metal core at an intermediate position between the formed arms.

4. A method for molding an arm for an elastic doll, comprising the steps of:

forming a molding space for molding a portion of the arm extending from a shoulder of the arm to a hand thereof in a mold, the shoulder of the arm being provided with an engagement groove adapted to be engaged with a trunk of a doll;

arranging a metal core in said molding space so as to extend along a center of said molding space and holding said core at a predetermined position in said molding space by a holding means;

arranging a support rod at a site in said molding space corresponding to said engagement groove, said support rod functioning to support said core against an injection pressure of a molding material during molding of the arm; and injecting a molding material into said molding space.

5. A method for molding an arm or arms for an elastic doll as defined in claim 1, wherein the shoulder of the arm is provided with an engagement groove adapted to be engaged with a trunk of a doll;

further comprising the step of arranging a support rod at a site in said molding space corresponding to said engagement groove, said support rod functioning to support said core against an injection pressure of a molding material during molding of the arm.

6. A method for molding arms for an elastic doll as defined in claim 2, further comprising the steps of:

separating said mold members from each other after molding of the arms; and removing a portion of the core exposed from the shoulder of each of the arms.

7. A method for molding arms for an elastic doll as defined in claim 2, wherein the shoulder of each arm is provided with an engagement groove adapted to be engaged with a trunk of a doll;

further comprising the step of arranging a support rod at a site in each molding space corresponding to said engagement groove, said support rod functioning to support said core against an injection pressure of a molding material during molding of the arm.

8. A method for molding arms for an elastic doll as defined in claim 3, further comprising the steps of:

separating said mold members from each other after molding of the arms; and removing a portion of the core exposed from the shoulder of each of the arms.

9. The method for molding an arm for an elastic doll in claim 1, further comprising the steps of:

providing a polyethylene spacer to encircle the metal core, the spacer having radial projections to space the metal core from encircling surfaces of the molding space.

10. The method for molding an arm for an elastic doll in claim 9, further comprising the steps of injecting a thermoplastic elastomer molding material having a melting point in a range of 100° C. to 170° C.

11. A method for molding an arm for an elastic doll, comprising the steps of:

forming a molding space for molding a portion of the arm extending from a shoulder thereof to a hand thereof in a mold;

arranging a metal core in said molding space, said metal core being fixed at one end thereof in a proximal section of said molding space which corresponds to a proximal portion of the shoulder of the arm;

attaching an annular synthetic resin spacer to encircle the metal core and position the metal core at the center of said molding space, the annular spacer has a plurality of projections that extend radially outward from the metal core on at least four sides, said metal core being provided at another end thereof or a portion thereof positioned in proximity to the another end with the spacer for keeping said metal core spaced at a predetermined interval from an inner surface of said molding space; and injecting a molten thermoplastic elastomer molding material having a melting point in a range of 100° C. to 170° C. into said molding space at a molding temperature to melt the spacer so that the spacer becomes integral with the molten molding material;

said spacer being made of a synthetic resin material which is compatible with said molding material and has a melting point below the molding temperature of said molding material.

12. The method for molding an arm for an elastic doll as defined in claim 11, further comprising the steps of:

providing a spacer of polyethylene.

13. The method for molding an arm for an elastic doll as defined in claim 12, further comprising providing a spacer with four equally spaced comical projections.

14. The method for molding an arm for an elastic doll as defined in claim 11, further comprising extending the metal core out of the molding space at one end and holding the extended metal core during the injection of molten thermoplastic elastomer molding material.

* * * * *